US008019603B2

(12) United States Patent
Martynovich et al.

(10) Patent No.: US 8,019,603 B2
(45) Date of Patent: Sep. 13, 2011

(54) APPARATUS AND METHOD FOR ENHANCING SPEECH INTELLIGIBILITY IN A MOBILE TERMINAL

(75) Inventors: Pavel Martynovich, Suwon-si (KR); Austin Kim, Seongnam-si (KR); Jae-Bum Kim, Seoul (KR); Chul-Yong Ahn, Suwon-si (KR)

(73) Assignee: Samsung Electronics Co., Ltd (KR)

( * ) Notice: Subject to any disclaimer, the term of this patent is extended or adjusted under 35 U.S.C. 154(b) by 832 days.

(21) Appl. No.: 12/062,034

(22) Filed: Apr. 3, 2008

(65) Prior Publication Data

US 2008/0249772 A1 Oct. 9, 2008

(30) Foreign Application Priority Data

Apr. 3, 2007 (KR) ..... 10-2007-0032918

(51) Int. Cl.
*G10L 21/02* (2006.01)

(52) U.S. Cl. ..... 704/233; 704/226

(58) Field of Classification Search ..... 704/226, 704/233

See application file for complete search history.

(56) References Cited

U.S. PATENT DOCUMENTS

| | | | | |
|---|---|---|---|---|
| 7,043,030 | B1 * | 5/2006 | Furuta | 381/94.1 |
| 7,725,315 | B2 * | 5/2010 | Hetherington et al. | 704/233 |
| 2005/0075870 | A1 * | 4/2005 | Chamberlain | 704/226 |
| 2006/0241938 | A1 | 10/2006 | Hetherington et al. | |

FOREIGN PATENT DOCUMENTS

| | | |
|---|---|---|
| JP | 2005-202335 | 7/2005 |
| KR | 1999-0044659 | 6/1999 |
| KR | 1020070062550 | 6/2007 |
| WO | WO 97/10586 | 3/1997 |

* cited by examiner

*Primary Examiner* — Abul K Azad
(74) *Attorney, Agent, or Firm* — The Farrell Law Firm, P.C.

(57) ABSTRACT

An apparatus and a method for enhancing speech intelligibility in a mobile terminal. A complex spectrum calculator calculates complex spectra of one input frame of an input speech signal by Fourier transform, a speech level calculator calculates its instant levels, an average speech level calculator calculates an average speech level of the speech frame using the instant levels, if the input frame is a speech frame, a scaling factor calculator calculates scaling factors by comparing the average speech level with the instant levels, an HPF characteristic calculator calculates amplitude characteristics using the scaling factors, a HPF high-pass-filters the complex spectra using the amplitude characteristics, a synthesizer converts high-pass-filtered signals to time signals by inverse Fourier transform and synthesizes the time signals, and a combiner outputs an enhanced intelligibility speech signal by combining the synthesized time signal with the input frame.

12 Claims, 6 Drawing Sheets

APPARATUS AND METHOD FOR ENHANCING SPEECH INTELLIGIBILITY IN A MOBILE TERMINAL

PRIORITY

This application claims priority under 35 U.S.C. §119(a) to a Korean Patent Application filed in the Korean Intellectual Property Office on Apr. 3, 2007 and assigned Serial No. 2007-32918, the entire disclosure of which is hereby incorporated by reference.

BACKGROUND OF THE INVENTION

1. Field of the Invention

The present invention generally relates to an apparatus and a method for enhancing speech intelligibility and outputting speech with the enhanced intelligibility in a mobile terminal. More particularly, the present invention relates to an apparatus and a method for enhancing speech intelligibility and outputting speech with the enhanced intelligibility by emphasizing a speech signal in a mobile terminal.

2. Description of the Related Art

Mobile terminals including hand-held phones can be used in environments with ambient noise like an airport or a station platform. Due to the ambient noise in the listener environment, the mobile terminals may provide very unintelligible speech to listeners.

Conventionally, the mobile terminals use a clipping circuit or an equalizer circuit to control output sound volume, or adopt a formant method in order to minimize noise corruption to speech intelligibility in a real environment.

Clipping is the simplest technique for enhancing speech intelligibility. Specific samples are clipped in an input signal and the entire signal is amplified. By use of an equalizer circuit, the mobile terminals can enhance speech intelligibility by converting an input signal to a high frequency range (2 KHz or higher). The volume control scheme increases the output sound volume in the presence of ambient noise and provides the increased volume to the listener.

However, the above three conventional methods amplify both a noise signal and a speech signal by amplifying an input signal. As a consequence, speech intelligibility drops.

Besides, speech intelligibility can be enhanced using peaks called formants in the frequency spectrum of a speech signal. The frequency spectrum of a speech signal involves three or fewer formants. In the case of three formants, these are called first, second and third formants in the order of low-to-high frequencies. This formant method enhances speech intelligibility by emphasizing high-order (the second and third) formants based on the property that amplitude (power) decreases in higher frequency in the speech spectrum. While the formant method can enhance speech intelligibility if only speech spectrum exists in a frequency band, it may decrease the speech intelligibility because components other than the formants are also emphasized in the case where the noise spectrum and the speech spectrum co-exist in the frequency band.

Accordingly, there exists a need for a new technique for enhancing speech intelligibility for a mobile terminal in a real noisy environment.

SUMMARY OF THE INVENTION

An aspect of exemplary embodiments of the present invention is to address at least the above problems and/or disadvantages and to provide at least the advantages described below. Accordingly, an aspect of the present invention is to provide an apparatus and a method for enhancing speech intelligibility in a mobile terminal.

Another aspect of the present invention provides an apparatus and a method for enhancing speech intelligibility and outputting speech with the enhanced intelligibility by emphasizing only a speech signal in a mobile terminal.

A further aspect of the present invention provides an apparatus and a method for enhancing speech intelligibility according to levels of a speech frame and outputting speech with the enhanced intelligibility in a mobile terminal.

In accordance with an aspect of the present invention, there is provided an apparatus for enhancing speech intelligibility in a mobile terminal, in which a complex spectrum calculator calculates complex spectra of one frame of an input speech signal by Fourier transform, a speech level calculator calculates instant levels of the frame, an average speech level calculator, if the frame is a speech frame, calculates an average speech level of the speech frame using the instant levels, a scaling factor calculator calculates scaling factors by comparing the average speech level with the instant levels, an HPF (High Pass Filter) characteristic calculator calculates amplitude characteristics for high-pass-filtering using the scaling factors, an HPF performs high-pass-filtering on the complex spectra based on the amplitude characteristics, a synthesizer converts high-pass-filtered signals to time signals by inverse Fourier transform and synthesizes the time signals, and a combiner outputs a speech signal with enhanced intelligibility by combining the synthesized time signal with the input frame.

In accordance with another aspect of the present invention, there is provided a method for enhancing speech intelligibility in a mobile terminal, in which complex spectra of one frame of an input speech signal are calculated by Fourier transform, instant levels of the frame are calculated, if the frame is a speech frame, an average speech level of the speech frame is calculated using the instant levels, scaling factors are calculated by comparing the average speech level with the instant levels, amplitude characteristics are calculated for high-pass-filtering using the scaling factors, high-pass-filtering is performed on the complex spectra based on the amplitude characteristics, high-pass-filtered signals are converted to time signals by inverse Fourier transform and synthesized, and a speech signal with enhanced intelligibility is output by combining the synthesized time signal with the input frame.

BRIEF DESCRIPTION OF THE DRAWINGS

The above and other objects, features and advantages of certain exemplary embodiments of the present invention will be more apparent from the following detailed description taken in conjunction with the accompanying drawings, in which.

Throughout the drawings, the same drawing reference numerals will be understood to refer to the same elements, features and structures.

DETAILED DESCRIPTION OF EXEMPLARY EMBODIMENTS

Matters defined in the description such as a detailed construction and elements are provided to assist in a comprehensive understanding of exemplary embodiments of the invention. Accordingly, those of ordinary skill in the art will recognize that various changes and modifications of the embodiments described herein can be made without departing from the scope and spirit of the invention. Also, descriptions of well-known functions and constructions are omitted for clarity and conciseness.

The principle of the present invention is that when a speech frame is detected from input frames, scaling factors are calculated for the speech frame, HPF characteristics are calculated for the levels of the speech frame using the scaling factors, and the speech frame is high-pass-filtered based on the HPF characteristics, thereby outputting a speech signal with enhanced intelligibility.

Figure 1:
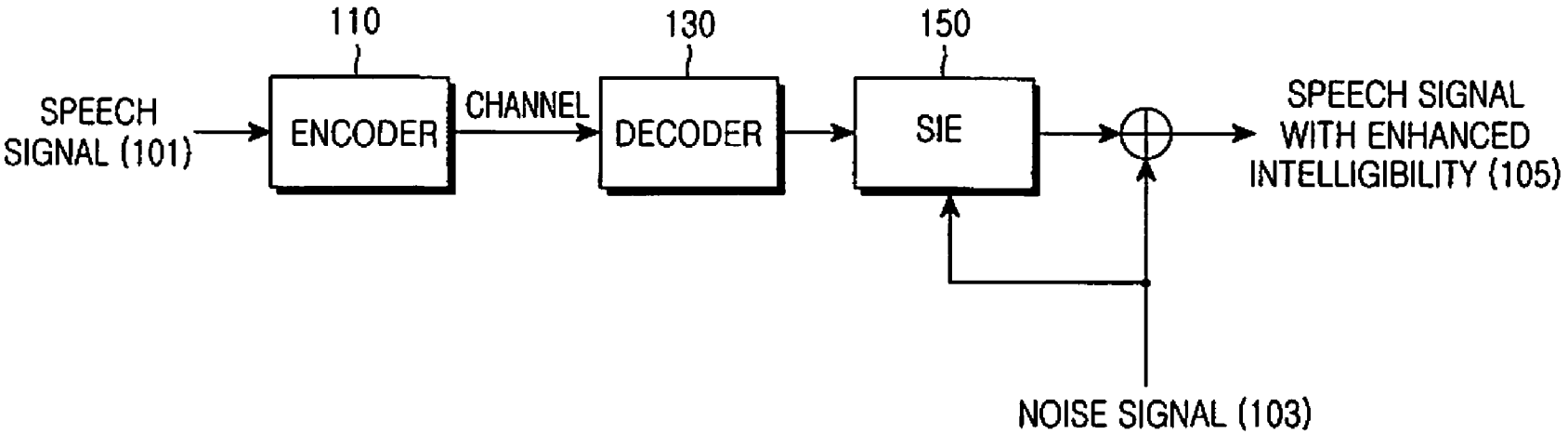
FIG. 1 (PRIOR ART)
FIG. 1 is a block diagram of a mobile communication system having a conventional Speech Intelligibility Enhancer (SIE)

FIG. 1 is a block diagram of a mobile communication system having an SIE.

Referring to FIG. 1, an encoder 110 in a transmitting terminal encodes a speech signal 101 received through a microphone and transmits the coded speech signal on a communication channel to a receiving terminal. A decoder 130 of the receiving terminal decodes the coded speech signal and an SIE 150 enhances the intelligibility of the decoded speech signal based on an ambient noise signal 103.

Figure 2:
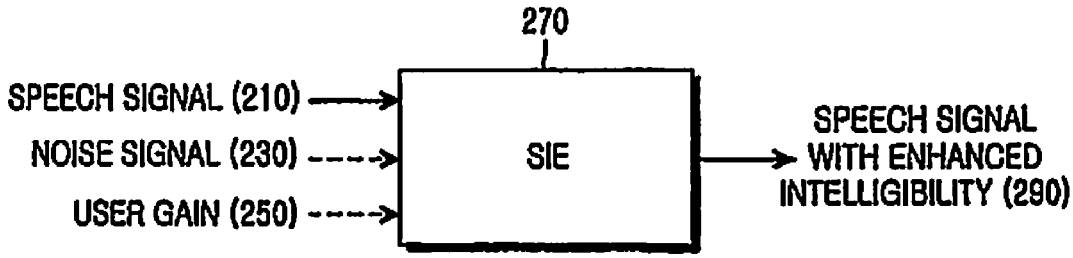
FIG. 2 illustrates input and output signals of an SIE according to an exemplary embodiment of the present invention.

FIG. 2 illustrates input and output signals of an SIE according to an exemplary embodiment of the present invention.

Referring to FIG. 2, an SIE 270 can receive three signals. For the input of a speech signal 210, the SIE 270 outputs a speech signal 290 with enhanced intelligibility. To do so, the SIE 270 can control the spectral variation of the speech signal 210 to some extent based on a noise signal 230 and/or a manually input user gain 250. The noise signal 230 is ambient noise collected through a microphone. The user gain 250 is a volume gain resulting from a general volume control. The SIE 270 outputs the intelligibility-enhanced speech signal 290 using the speech signal 210, the noise signal 230, and the user gain 250.

Figure 3:
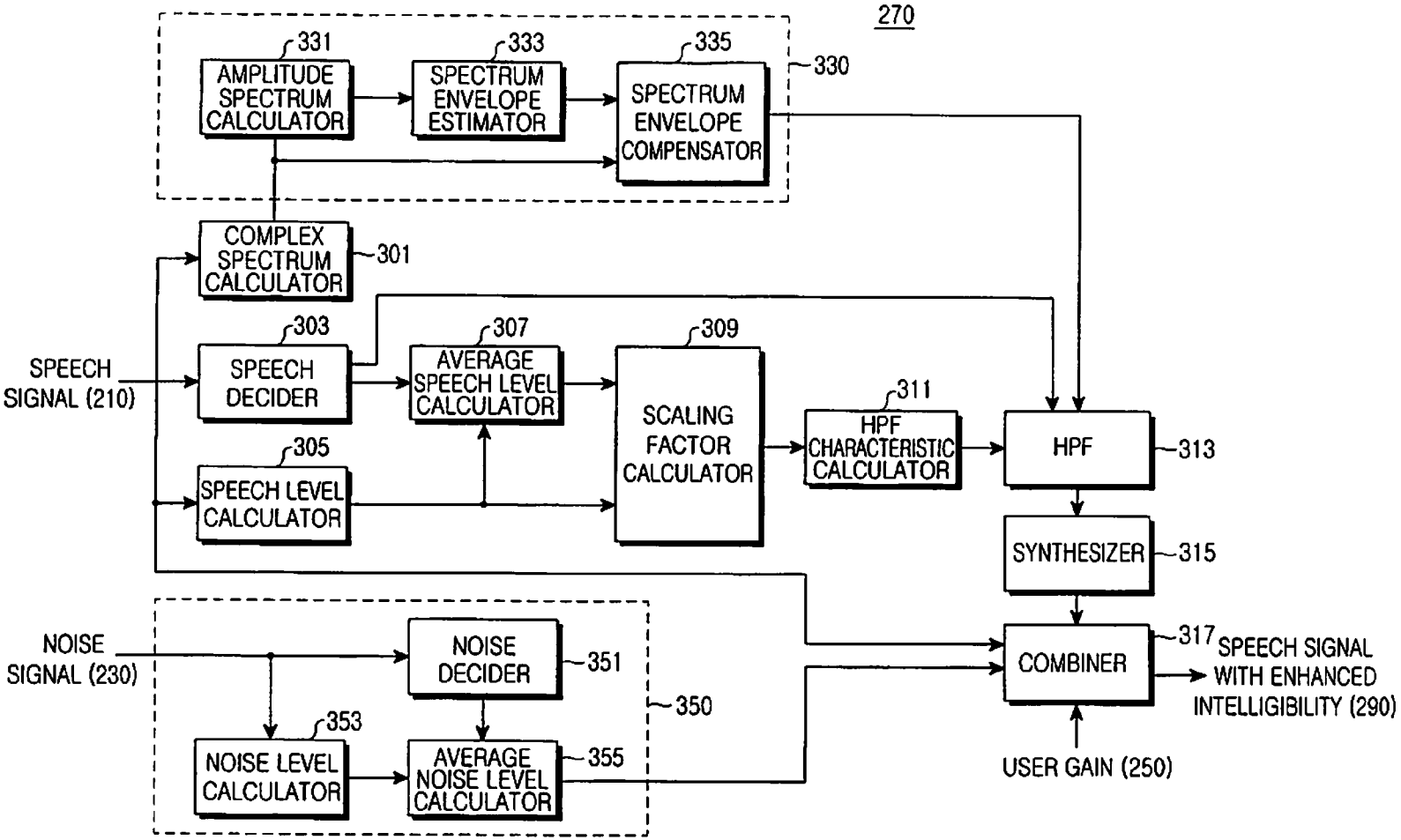
FIG. 3 is a detailed block diagram of the SIE according to the exemplary embodiment of the present invention.

FIG. 3 is a detailed block diagram of the SIE according to the present invention.

Referring to FIG. 3, the SIE 270 includes a complex spectrum calculator 301, a speech decider 303, a speech level calculator 305, an average speech level calculator 307, a scaling factor calculator 309, an HPF characteristic calculator 311, an HPF 313, a synthesizer 315, and a combiner 317. The SIE 270 may optionally further include a spectrum pre-processor 330 and a noise calculator 350.

A frame of a speech signal 210 is provided to the complex spectrum calculator 301, the speech decider 303, and the speech level calculator 305. Frames x(f,t) input to the SIE 270 include speech frames having real speech and noise (or mute) frames intervened between real speech. f denotes a frame count ranging from 0 to F−1 where F is the total number of frames and t denotes a time index or a sample count, ranging from 0 to T−1 where T is the number of samples per frame.

The complex spectrum calculator 301 calculates complex spectra X(f,i) by Fourier-transforming an input frame x(f,t) and provides the complex spectra X(f,i) to the spectrum pre-processor 270. In the absence of the spectrum pre-processor 330, the complex spectrum calculator 301 provides the complex spectra X(f,i) to the HPF 313. Herein, i denotes a frequency bin index ranging from 0 to l−1 where l is the number of frequency bins.

The speech decider 303 determines whether the input frame x(f,t) is a speech frame or a noise frame by measuring its voice activity. If the input frame x(f,t) is a speech frame, the speech decider 303 provides the speech frame to the average speech level calculator 307. If the input frame x(f,t) is a noise frame, the speech decider 303 provides the noise frame to the HPF 313. In another case, the speech detector 303 simply notifies the average speech level calculator 307 and the HPF 313 whether the input frame x(f,t) is a speech frame or a noise frame.

The speech level calculator 305 calculates the instant level LS(f) of each short segment of the input frame x(f,t).

If the input frame x(f,t) is a speech frame, the average speech level calculator 307 calculates the average speech level ES(f) of the speech frame using instant levels LS(f) calculated for a predetermined time period.

The scaling factor calculator 309 calculates scaling factors for low and high levels of the speech frame to increase a speech volume with respect to the low and high levels by comparing the average speech level ES(f) with the instant levels LS(f) according to Equation (1):

$$G(f)=C\times ES(f)/LS(f) \tag{1}$$

where C is a predetermined constant that is a required Signal-to-Noise Ratio (SNR). The scaling factor calculator 309 calculates a scaling factor to be an amplification factor, if an instant level LS(f) is lower than the average speech level ES(f) or a predetermined attenuation. This scaling factor calculation is called amplitude compression.

The HPF characteristic calculator 311 calculates HPF amplitude characteristics H(f,i) using the scaling factors G(f). The scaling factors G(f) have been computed to increase the speech volume at the low and high levels of the speech frame. However, the volumes at the low and high levels of the speech frame affect differently speech intelligibility. Therefore, the speech frame should be scaled according to frequency bands with respect to each level.

Accordingly, an exemplary embodiment of the present invention performs scaling based on the fact that a consonant that affects speech intelligibility significantly has a peak in a frequency band higher than the frequency band of a vowel. That is, the HPF characteristic calculator 311 calculates HPF amplitude characteristics as illustrated in FIGS. 4A and 4B.

Figure 4A:
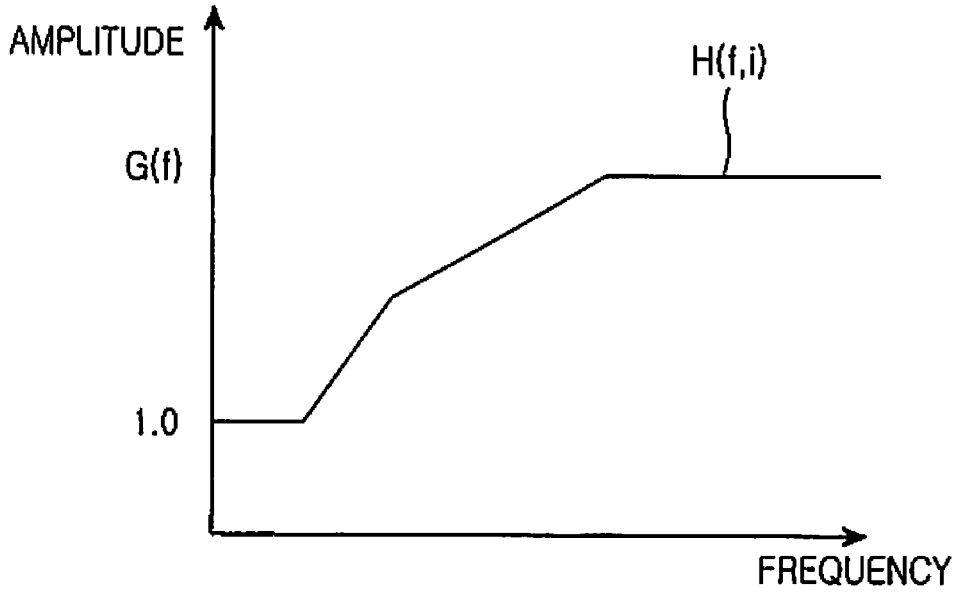
FIGS. 4A and 4B are graphs illustrating High Pass Filter (HPF) amplitude characteristics according to scaling factors in the SIE illustrated in FIG. 3.
Figure 4B:
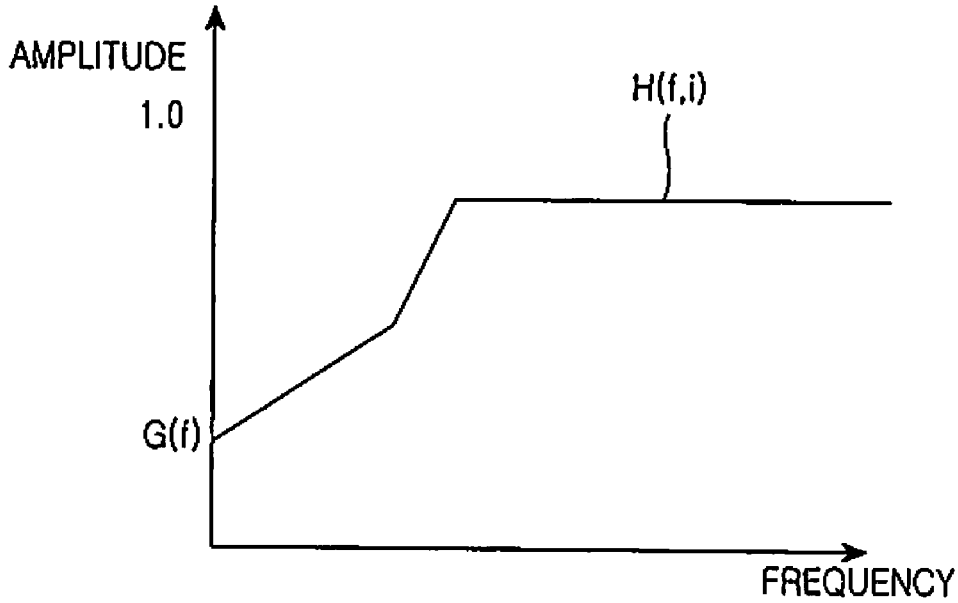

FIGS. 4A and 4B are graphs illustrating HPF amplitude characteristics according to scaling factors in the SIE illustrated in FIG. 3.

The HPF characteristic calculator 311 outputs HPF amplitude characteristics H(f,i) having an amplitude of at least 1 in a low frequency band and an amplitude of up to a scaling factor G(f) in a high frequency band, if the scaling factor G(f) is greater than 1. If the scaling factor G(f) is equal to or less than 1, the HPF characteristic calculator 311 outputs HPF amplitude characteristics H(f,i) having an amplitude of at least the scaling factor G(f) in the low frequency band and an amplitude of up to 1 in the high frequency band.

Referring to FIG. 3 again, the HPF 313 performs high-pass-filtering on a complex spectrum X(f,i) based on the HPF amplitude characteristics H(f,i).

Hence, as shown in Equation (2):

$$Xo(f,i)=X(f,i)\times H(f,i) \tag{2}$$

where Xo(f,i) denotes a high-pass-filtered signal.

The synthesizer 315 converts high-pass-filtered signals Xo(f,i) to time signals by inverse Fourier transform and synthesizes the time signals in an overlap-and-add method.

The combiner 317 combines the synthesized time signal with the input frame x(f,t) and outputs an intelligibility-enhanced speech signal 290. If the combiner 317 receives a user gain 250, it combines the user gain 250 with the intelligibility-enhanced speech signal 290.

Meanwhile, the SIE 270 can output the intelligibility-enhanced speech signal 290 by optionally further using the spectrum pre-processor 330 and the noise calculator 350.

The spectrum pre-processor 330 includes an amplitude spectrum calculator 331, a spectrum envelope estimator 333, and a spectrum envelope compensator 335.

The amplitude spectrum calculator 331 calculates amplitude spectra A(f,i) based on the intensities of the complex spectra X(f,i) by Equation (3):

$$A(f,i)=|X(f,i)| \tag{3}$$

The spectrum envelope estimator 335 estimates the spectrum envelopes (envelopes connecting spectral peaks at low to high frequencies) of the amplitude spectrum A(f,i) using a filter bank in the frequency area of the amplitude spectra A(f,i). Herein, the filter characteristic of each filter included in the filter bank is triangular and the bandwidth of each filter is wide enough to mitigate the effects of pitch harmonics.

The spectrum envelope compensator 335 compensates the spectrum envelopes by amplifying the spectra of formant bandwidths to emphasize formants and attenuating spectra that are not important to speech intelligibility. The spectrum envelopes can be compensated in various ways. One of them will be described below with reference to FIGS. 5A and 5B.

Figure 5A:
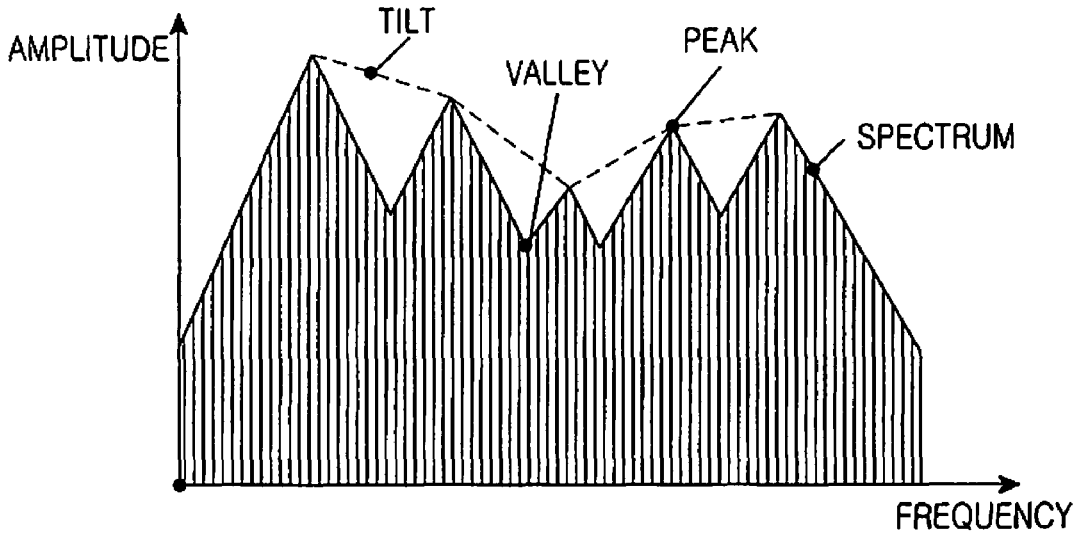
FIG. 5A illustrates an exemplary spectral envelope estimated by the SIE illustrated in FIG. 3.
Figure 5B:
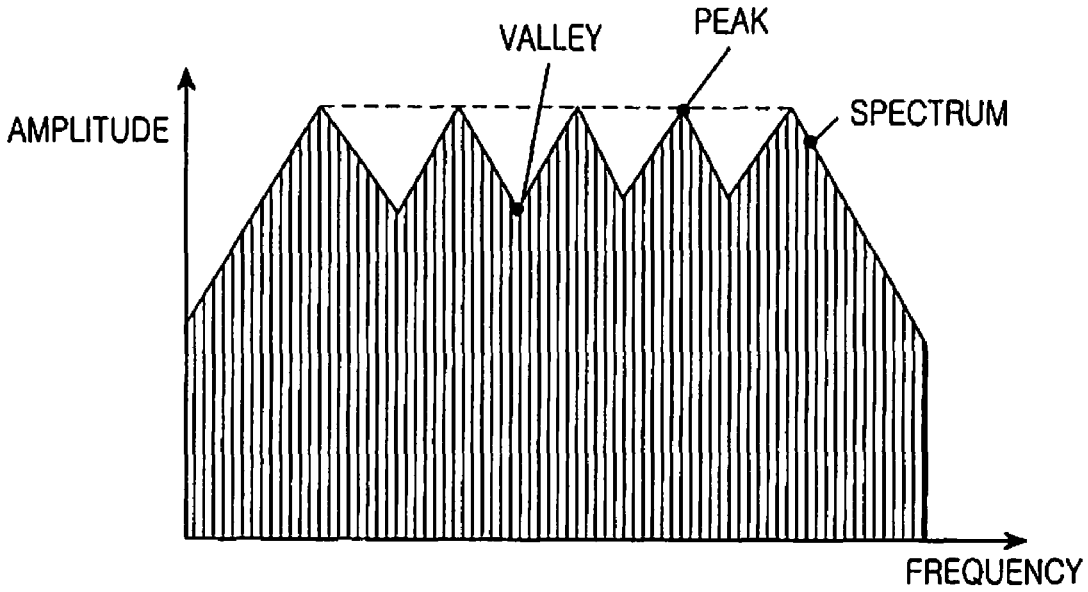
FIG. 5B illustrates an exemplary spectral envelope compensated by the SIE illustrated in FIG. 3.

FIG. 5A illustrates an exemplary spectral envelope estimated by the SIE illustrated in FIG. 3 and FIG. 5B illustrates an exemplary spectral envelope compensated by the SIE illustrated in FIG. 3.

When tilts that can activate low frequency components exist in the estimated spectrum envelope illustrated in FIG. 5A, the spectrum envelope compensator 335 produces the tilt-free spectrum envelope illustrated in FIG. 5B by eliminating the tilts from the estimated spectrum envelope. Then the spectrum envelope compensator 335 compensates the spectrum envelope of the complex spectrum by applying the tilt-free spectrum envelope to the complex spectrum.

The compensated spectrum envelope Xa(f,i) has amplitudes ranging from 0 to 1, equal peaks, and valleys having close-to-zero values. Hence, the speech intelligibility can further be enhanced by emphasizing formants and attenuating valleys using the compensated spectrum envelope Xa(f,i) according the present invention.

If the SE 270 has the spectrum pre-processor 330 and thus the HPF 313 receives the compensated spectrum envelopes Xa(f,i), the HPF 313 performs high-pass-filtering on the compensated spectrum envelopes Xa(f,i) based on the HPF amplitude characteristics H(f,i). Thus, as shown in Equation (4):

$$Xo(f,i)=Xa(f,i)\times H(f,i) \tag{4}$$

The noise calculator 350 (that is optional to the SIE 270) includes a noise decider 351, a noise level calculator 353, and an average noise level calculator 355.

One frame of a noise signal 230 is provided to the noise decider 351 and the noise level calculator 353. The noise signal 230 can be collected through a microphone of a receiving terminal, for example. The noise decider 351 determines whether speech exists in a noise frame n(f,t). If the noise frame n(f,t) includes only noise, the noise decider 351 provides it to the average noise level calculator 355.

The noise level calculator 353 calculates the instant level LN(f) of each short segment of the current input noise frame.

The average noise level calculator 355 calculates the average noise level EN(f) of the noise frame using instant levels LN(f) calculated for a predetermined time period.

When the SIE 270 has the noise calculator 350 and the combiner 317 receives the average noise level EN(f) from the noise calculator 350, the combiner 317 combines the synthesized time signal with the input speech frame x(f,t) and removes noise of the average noise level EN(f) from the combined signal, thus outputting the intelligibility-enhanced speech signal 290.

Figure 6:
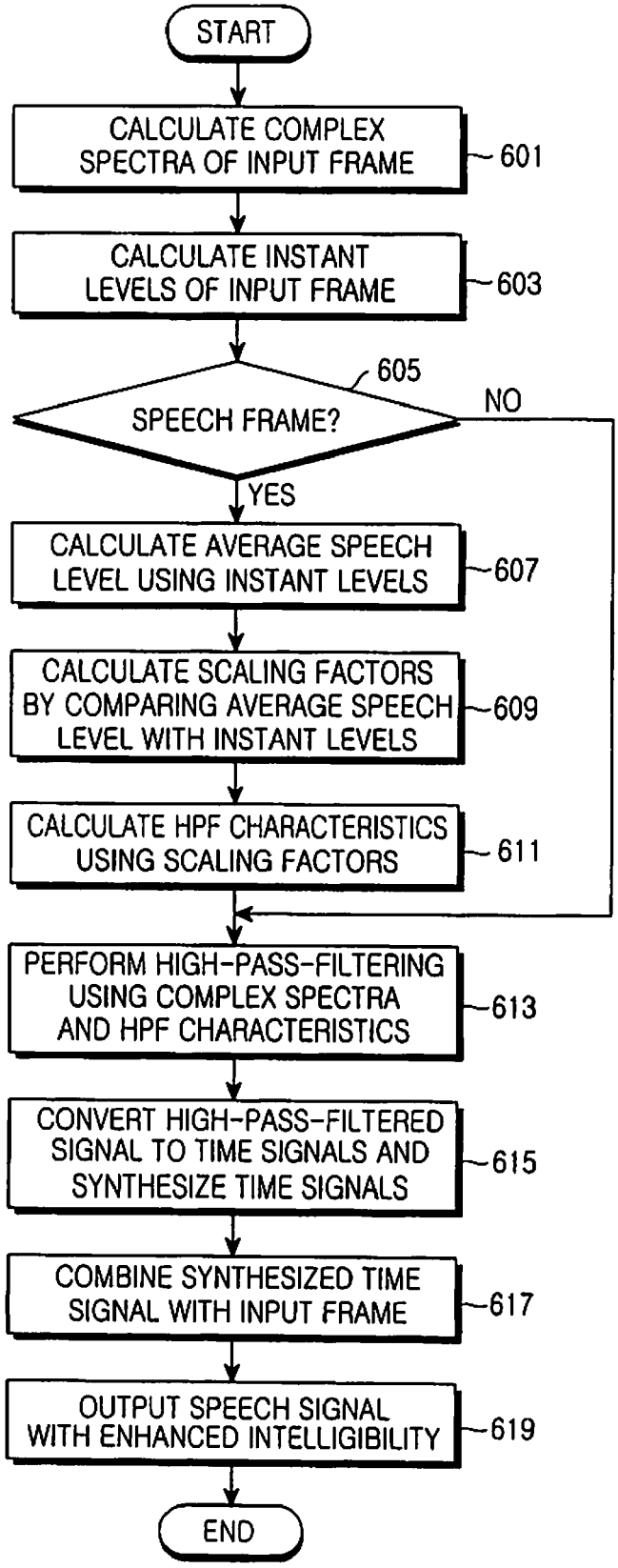
FIG. 6 is a flowchart illustrating an SIE method according an exemplary embodiment of the present invention.

FIG. 6 is a flowchart illustrating an SIE method according the present invention. Only the HPF operation is described herein, without taking into account spectrum pre-processing and the effects of noise.

Referring to FIG. 6, the complex spectrum calculator 301 calculates the complex spectra X(f,i) of an input frame x(f,t) by Fourier transform in step 601. The speech level calculator 305 calculates the instant level LS(f) of each short segment of the input frame x(f,t) in step 603.

In step 605, the speech decider 303 determines whether the input frame x(f,t) is a speech frame. If the input frame x(f,t) is a speech frame, the procedure goes to step 607. If the input frame x(f,t) is a noise frame, the procedure jumps to step 613.

The average speech level calculator 307 calculates the average speech level ES(f) of the speech frame using the instant levels LS(f) in step 607. The scaling factor calculator 309 calculates scaling factors for low and high levels of the speech frame to increase a speech volume with respect to the low and high levels by comparing the average speech level ES(f) with the instant levels LS(f) by equation (1) in step 609.

In step 611, the HPF characteristic calculator 311 calculates HPF amplitude characteristics H(f,i) using the scaling factors G(f). The HPF 313 performs high-pass-filtering on the complex spectra X(f,i) based on the HPF amplitude characteristics H(f,i) and outputs a high-pass-filtered signal described by Equation (2) in step 613. In step 615, the synthesizer 315 converts the high-pass-filtered signals to time signals by inverse Fourier transform and synthesizes the time signals in an overlap-and-add method. The combiner 317 combines the synthesized time signal with the input frame x(f,t) and outputs an intelligibility-enhanced speech signal in step 619.

As described above, a speech signal with enhanced intelligibility can be output by computing scaling factors for a speech frame based on the fact that a consonant affecting speech intelligibility significantly exist in a higher frequency band than a vowel, calculating HPF characteristics according to levels of the speech frame, and performing high-pass-filtering according to the HPF characteristics.

As is apparent from the above description, the present invention selects a speech frame, calculates scaling factors for the speech frame, calculates HPF characteristics for levels of the speech frame, and performs high-pass-filtering using the HPF characteristics. Therefore, a speech signal with enhanced intelligibility can be output.

While the invention has been shown and described with reference to certain exemplary embodiments of the present invention thereof, it will be understood by those skilled in the art that various changes in form and details may be made therein without departing from the spirit and scope of the present invention as defined by the appended claims and their equivalents.

What is claimed is:

1. An apparatus for enhancing speech intelligibility in a mobile terminal, comprising:

a complex spectrum calculator for calculating complex spectra of one input frame of an input speech signal by Fourier transform;

a speech level calculator for calculating instant levels of the input frame;

an average speech level calculator for, when the input frame is a speech frame, calculating an average speech level of the speech frame using the instant levels;

a scaling factor calculator for calculating scaling factors by comparing the average speech level with the instant levels;

a High Pass Filter (HPF) characteristic calculator for calculating amplitude characteristics for high-pass-filtering using the scaling factors;

a HPF for performing high-pass-filtering on the complex spectra based on the amplitude characteristics;

a synthesizer for converting high-pass-filtered signals to time signals by inverse Fourier transform and synthesizing the time signals; and a combiner for outputting an enhanced intelligibility speech signal by combining the synthesized time signals with the input frame.

2. The apparatus of claim 1, wherein when a calculated scaling factor is greater than 1, the amplitude characteristics have an amplitude of at least 1 in a low frequency band and an amplitude of up to the calculated scaling factor in a high frequency band, and when the calculated scaling factor is equal to or less than 1, the amplitude characteristics have an amplitude of at least the calculated scaling factor in a low frequency band and an amplitude of up to 1 in a high frequency band.

3. The apparatus of claim 1, further comprising:

an amplitude spectrum calculator for calculating the amplitude spectra based on intensities of the complex spectra;

a spectrum envelope estimator for estimating spectrum envelopes of the amplitude spectra using a filter bank in a frequency area of the amplitude spectra; and a spectrum envelope compensator for compensating the estimated spectrum envelopes by amplifying spectra of formant bandwidths in the estimated spectrum envelopes and providing the compensated spectrum envelopes as the complex spectra to the HPF.

4. The apparatus of claim 1, further comprising:

a noise level calculator for calculating noise instant levels of one input noise frame of an input noise signal;

a noise decider determining whether the input noise frame includes only noise; and an average noise level calculator for, when the input noise frame includes only noise, calculating an average noise level of the input noise frame using the noise instant levels and providing the average noise level to the combiner so that effects of the noise can be eliminated from the enhanced intelligibility speech signal.

5. The apparatus of claim 1, wherein the combiner adjusts volume of the enhanced intelligibility speech signal by applying a user gain to the enhanced intelligibility speech signal.

6. The apparatus of claim 1, further comprising a speech decider determining whether the input frame is a speech frame and, when the input frame is a speech frame, providing the speech frame to the average speech level calculator.

7. A method for enhancing speech intelligibility in a mobile terminal, comprising:

calculating complex spectra of one input frame of an input speech signal by Fourier transform;

calculating instant levels of the input frame;

calculating, when the input frame is a speech frame, an average speech level of the speech frame using the instant levels;

calculating scaling factors by comparing the average speech level with the instant levels;

calculating amplitude characteristics for high-pass-filtering using the scaling factors;

performing high-pass-filtering on the complex spectra based on the amplitude characteristics;

converting high-pass-filtered signals to time signals by inverse Fourier transform and synthesizing the time signals; and outputting an enhanced intelligibility speech signal by combining the synthesized time signals with the input frame.

8. The method of claim 7, wherein when a calculated scaling factor is greater than 1, the amplitude characteristics have an amplitude of at least 1 in a low frequency band and an amplitude of up to the calculated scaling factor in a high frequency band, and when the calculated scaling factor is equal to or less than 1, the amplitude characteristics have an amplitude of at least the calculated scaling factor in a low frequency band and an amplitude of up to 1 in a high frequency band.

9. The method of claim 7, further comprising:

calculating the amplitude spectra based on intensities of the complex spectra;

estimating spectrum envelopes of the amplitude spectra using a filter bank in a frequency area of the amplitude spectra; and compensating the estimated spectrum envelopes by amplifying spectra of formant bandwidths in the estimated spectrum envelopes and outputting the compensated spectrum envelopes as the complex spectra for the high-pass-filtering.

10. The method of claim 7, further comprising:

calculating noise instant levels of one input noise frame of an input noise signal;

determining whether the input noise frame includes only noise; and calculating, when the input noise frame includes only noise, an average noise level of the noise frame using the noise instant levels and providing the average noise level for the combining so that effects of the noise can be eliminated from the enhanced intelligibility speech signal.

11. The method of claim 7, further comprising adjusting volume of the enhanced intelligibility speech signal by applying a user gain to the enhanced intelligibility speech signal.

12. The method of claim 7, further comprising determining whether the input frame is a speech frame and, when the input frame is a speech frame, providing the speech frame for the average speech level calculation.

* * * * *